US009214765B2

(12) United States Patent
Zheng et al.

(10) Patent No.: US 9,214,765 B2
(45) Date of Patent: Dec. 15, 2015

(54) ELECTRICAL CONNECTOR WITH METAL PLATE

(71) Applicant: HON HAI PRECISION INDUSTRY CO., LTD., New Taipei (TW)

(72) Inventors: Qi-Sheng Zheng, Kunshan (CN); Guo-Hua Zhang, Kunshan (CN); Ji-Chao Wang, Kunshan (CN); Hong-Bin Gong, Kunshan (CN); Xiao-Wei Gong, Kunshan (CN)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/288,186

(22) Filed: May 27, 2014

(65) Prior Publication Data

US 2014/0357122 A1 Dec. 4, 2014

(30) Foreign Application Priority Data

May 31, 2013 (CN) ..... 2013 2 03092839

(51) Int. Cl.
*H01R 13/658* (2011.01)
*H01R 13/6581* (2011.01)

(52) U.S. Cl.
CPC ..... *H01R 13/6581* (2013.01)

(58) Field of Classification Search
CPC ..... H01R 13/659
See application file for complete search history.

(56) References Cited

U.S. PATENT DOCUMENTS 5,797,770 A * 8/1998 Davis et al. ..... 439/607.27
6,027,375 A * 2/2000 Wu ..... 439/607.02
6,099,351 A * 8/2000 Wu ..... 439/607.43
6,113,428 A * 9/2000 Yeh ..... 439/607.17
6,139,367 A * 10/2000 Yeh ..... 439/607.17
6,155,872 A * 12/2000 Wu ..... 439/541.5
6,159,039 A * 12/2000 Wu ..... 439/541.5
6,162,089 A * 12/2000 Costello et al. ..... 439/541.5
6,166,892 A * 12/2000 Wu ..... 361/79
6,238,241 B1 * 5/2001 Zhu et al. ..... 439/541.5
6,238,244 B1 * 5/2001 Yang ..... 439/607.01
6,273,757 B1 * 8/2001 David et al. ..... 439/607.13
6,350,152 B1 * 2/2002 Belopolsky et al. ..... 439/541.5
6,394,846 B1 * 5/2002 Belopolsky et al. ..... 439/620.11
6,478,610 B1 * 11/2002 Zhou et al. ..... 439/490
6,520,799 B1 * 2/2003 Cheng et al. ..... 439/541.5
6,540,563 B1 * 4/2003 Hu et al. ..... 439/676
6,835,092 B2 * 12/2004 Wan et al. ..... 439/541.5
6,939,168 B2 * 9/2005 Oleynick et al. ..... 439/541.5

(Continued)

FOREIGN PATENT DOCUMENTS

CN 102315560 A 6/2011

OTHER PUBLICATIONS

Data sheet for CN102315560, Li et al., Jan. 11, 2012.*

*Primary Examiner* — Ross Gushi
(74) *Attorney, Agent, or Firm* — Ming Chieh Chang; Wei Te Chung

(57) ABSTRACT

An electrical connector comprises an insulative housing, a plurality of contacts, a shield shell covering the insulative housing and a shield plate. The insulative housing has a body portion and a spacer. The contacts are received in the body portion. The shield shell includes a out shell and an inner shell, the inner shell is separated the insulative housing covering by the out shell to two parts each are upper inserting space and bottom inserting space. The shield plate received in the spacer and abutting against the inner shell electrically.

20 Claims, 7 Drawing Sheets

(56) References Cited

U.S. PATENT DOCUMENTS

| | | | | |
|---|---|---|---|---|
| 7,008,762 | B2 * | 3/2006 | Zhang et al. | 439/541.5 |
| 7,044,779 | B1 * | 5/2006 | Liu | 439/541.5 |
| 7,052,322 | B2 * | 5/2006 | Hu et al. | 439/607.25 |
| 7,081,017 | B2 * | 7/2006 | Shuey et al. | 439/607.36 |
| 7,207,836 | B2 * | 4/2007 | Tsai | 439/541.5 |
| 7,320,618 | B2 * | 1/2008 | Tsai | 439/541.5 |
| 7,357,668 | B2 * | 4/2008 | Wan et al. | 439/541.5 |
| 7,364,463 | B1 * | 4/2008 | Ju | 439/607.55 |
| 7,481,677 | B1 * | 1/2009 | Yi et al. | 439/607.01 |
| 7,488,207 | B2 * | 2/2009 | Zheng et al. | 439/541.5 |
| 7,588,445 | B2 * | 9/2009 | He et al. | 439/79 |
| 7,588,458 | B2 * | 9/2009 | He et al. | 439/541.5 |
| 7,604,490 | B2 * | 10/2009 | Chen et al. | 439/79 |
| 7,625,243 | B2 * | 12/2009 | Chen et al. | 439/660 |
| 7,650,695 | B1 * | 1/2010 | Ju | 29/884 |
| 7,651,371 | B2 * | 1/2010 | Yi et al. | 439/541.5 |
| 7,670,191 | B2 * | 3/2010 | Ortega et al. | 439/660 |
| 7,690,947 | B2 * | 4/2010 | Gu et al. | 439/607.23 |
| 7,731,535 | B1 * | 6/2010 | Wan et al. | 439/607.4 |
| 7,758,380 | B2 * | 7/2010 | Wang et al. | 439/607.23 |
| 7,811,110 | B2 * | 10/2010 | He et al. | 439/218 |
| 7,837,499 | B1 * | 11/2010 | Chen | 439/541.5 |
| 7,905,750 | B2 * | 3/2011 | Mo | 439/541.5 |
| 7,922,525 | B2 * | 4/2011 | Lee | 439/541.5 |
| 7,997,927 | B2 * | 8/2011 | Wan et al. | 439/541.5 |
| 8,070,512 | B2 * | 12/2011 | Xuan et al. | 439/541.5 |
| 8,096,831 | B2 * | 1/2012 | Hsu et al. | 439/607.01 |
| 8,187,029 | B2 * | 5/2012 | Yu et al. | 439/541.5 |
| 8,568,171 | B2 * | 10/2013 | Yang et al. | 439/607.27 |
| 2006/0014431 | A1 * | 1/2006 | Shuey et al. | 439/607 |
| 2006/0183371 | A1 * | 8/2006 | Tsai | 439/541.5 |
| 2007/0077816 | A1 * | 4/2007 | Wan et al. | 439/607 |
| 2010/0291798 | A1 * | 11/2010 | Kondo et al. | 439/607.08 |
| 2014/0017951 | A1 * | 1/2014 | Tsai | 439/638 |
| 2014/0357122 | A1 * | 12/2014 | Zheng et al. | 439/607.27 |
| 2014/0364007 | A1 * | 12/2014 | Wang et al. | 439/607.01 |

* cited by examiner

ELECTRICAL CONNECTOR WITH METAL PLATE

BACKGROUND OF THE INVENTION

1. Field of the Invention

The present invention generally relates to an electrical connector and more particularly to an electrical connector with a metal plate retained to a spacer of the electrical connector.

2. Description of Related Art

Chinese patent No. 102315560, published on Jun. 1, 2011, discloses a stacked electrical connector including an insulative housing, a plurality of contacts, a shield shell and a shield plate. The insulative housing includes a body portion, a number of tongues assembled into the body and a spacer mounted in the body portion. The tongues include an upper tongue and a bottom tongue. The contacts include an upper group of contacts received in the upper tongue and a bottom group of contacts received in the bottom tongue. The shield plate is received in the spacer and located between the upper and the bottom group of contacts. The shield shell includes an inner shell and an out shell. The shield plate only contacts with the out shell for grounding. But the cross-talk between the upper and bottom contacts would be reduced poor.

So, an improved connector is needed.

SUMMARY OF THE INVENTION

The present invention provides an electrical connector comprises an insulative housing, a plurality of contacts, a shield shell covering the insulative housing and a shield plate. The insulative housing has a body portion and a spacer. The contacts are received in the body portion. The shield shell includes a out shell and an inner shell, the inner shell is separated the insulative housing covering by the out shell to two parts each are upper inserting space and bottom inserting space. The shield plate received in the spacer and abutting against the inner shell electrically. The cross-talk between the upper and bottom group of contacts and it would improve signal transmission quality of the electrical connector Other objects, advantages and novel features of the present invention will become more apparent from the following detailed description of the present embodiment when taken in conjunction with the accompanying drawings.

DETAILED DESCRIPTION OF THE INVENTION

Figure 1:
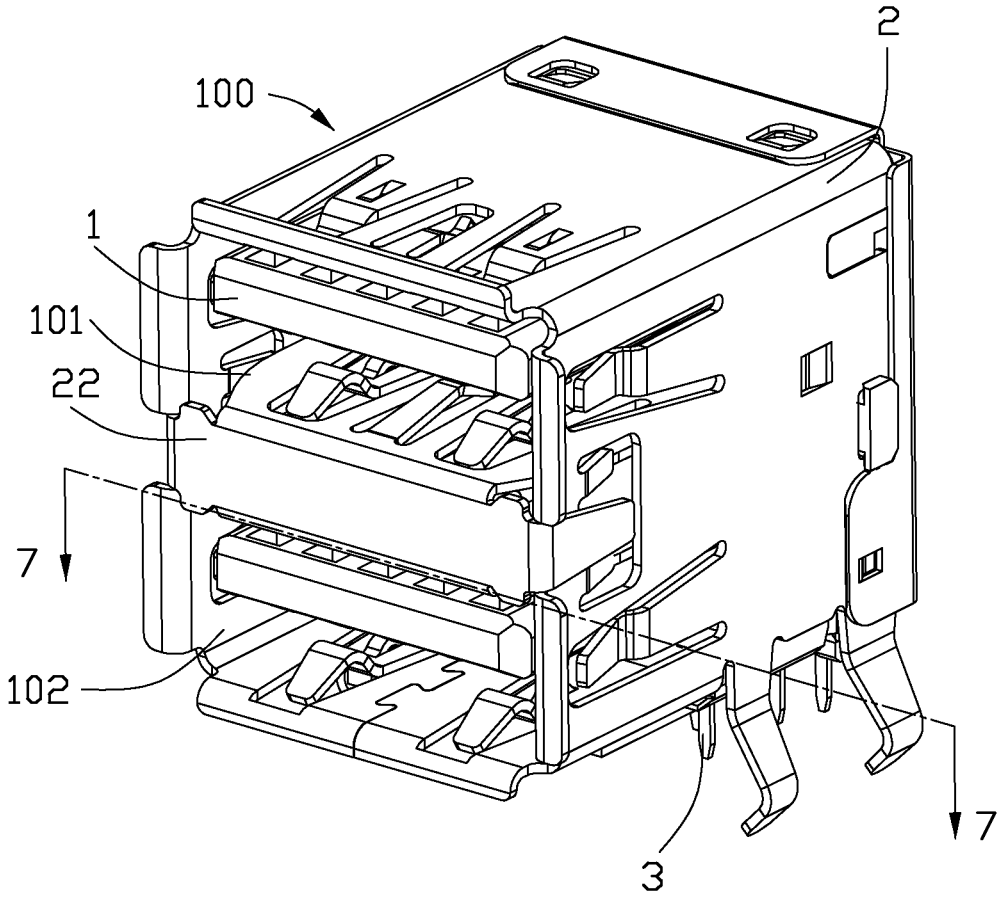
FIG. 1 is an assembled perspective view of an electrical connector according to a preferred embodiment of the present invention.

Reference will now be made to the drawing figures to describe the preferred embodiment of the present invention in detail.

Figure 2:
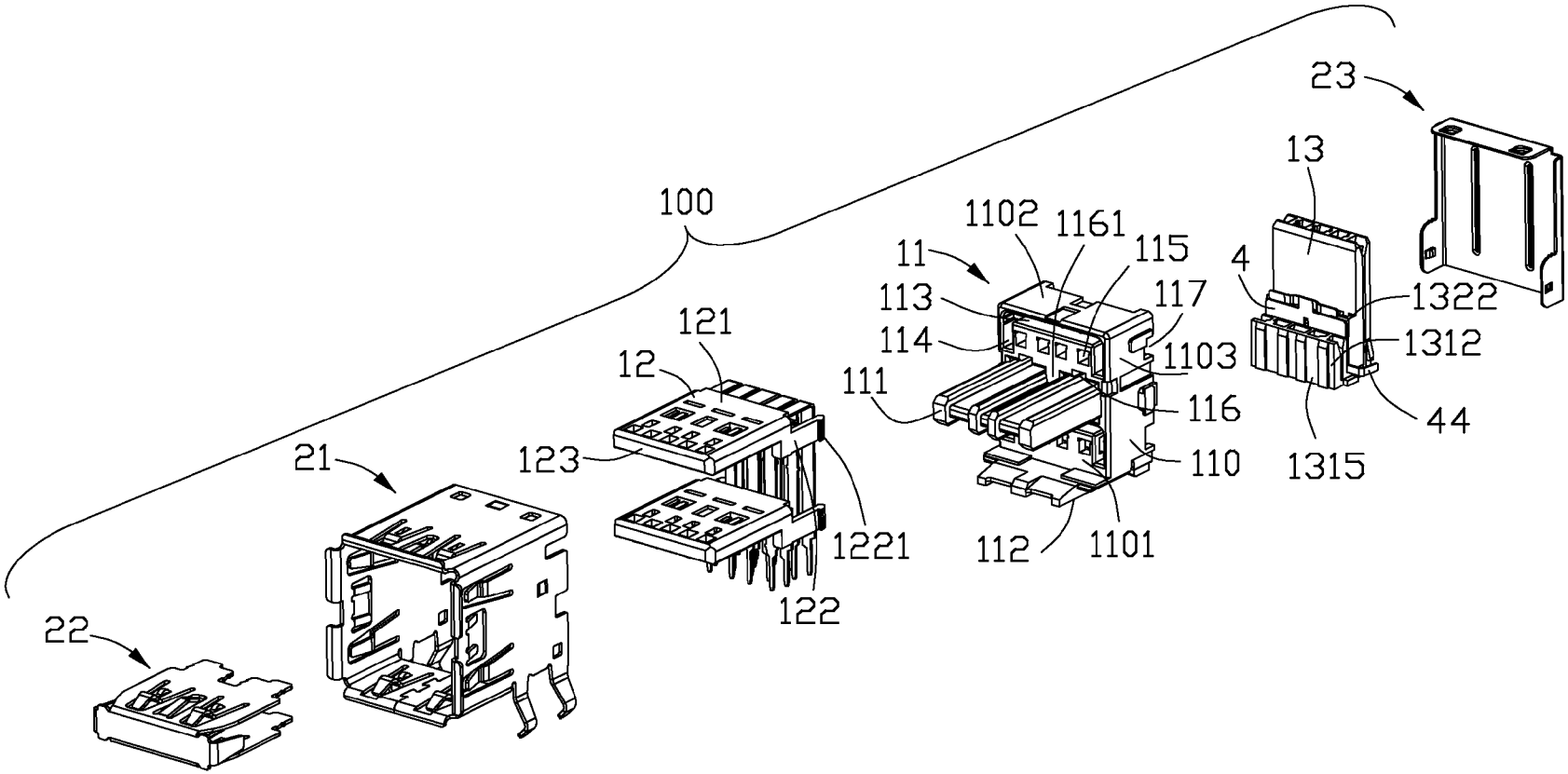
FIG. 2 is a partially exploded perspective view of the electrical connector.

Referring to FIGS. 1-2, an stacked electrical connector 100 comprises an insulative housing 1, a shield shell 2 covering the insulative housing 1, a plurality of contacts 3 received in the insulative housing 1 and a shield plate 4 received in the insulative housing, 1.

Figure 5:
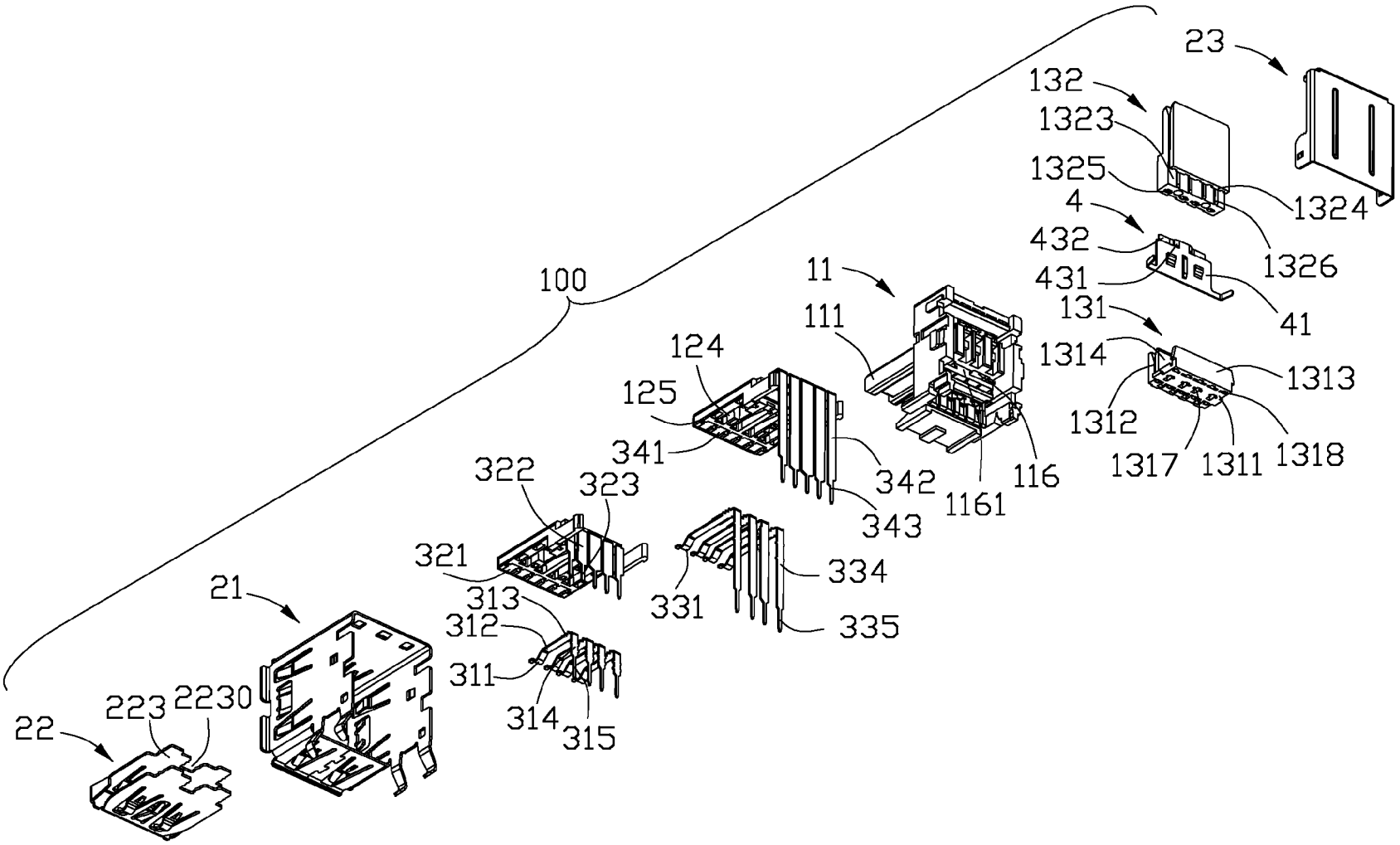
FIG. 5 is similar with FIG. 4, but taken from another side.
Figure 6:
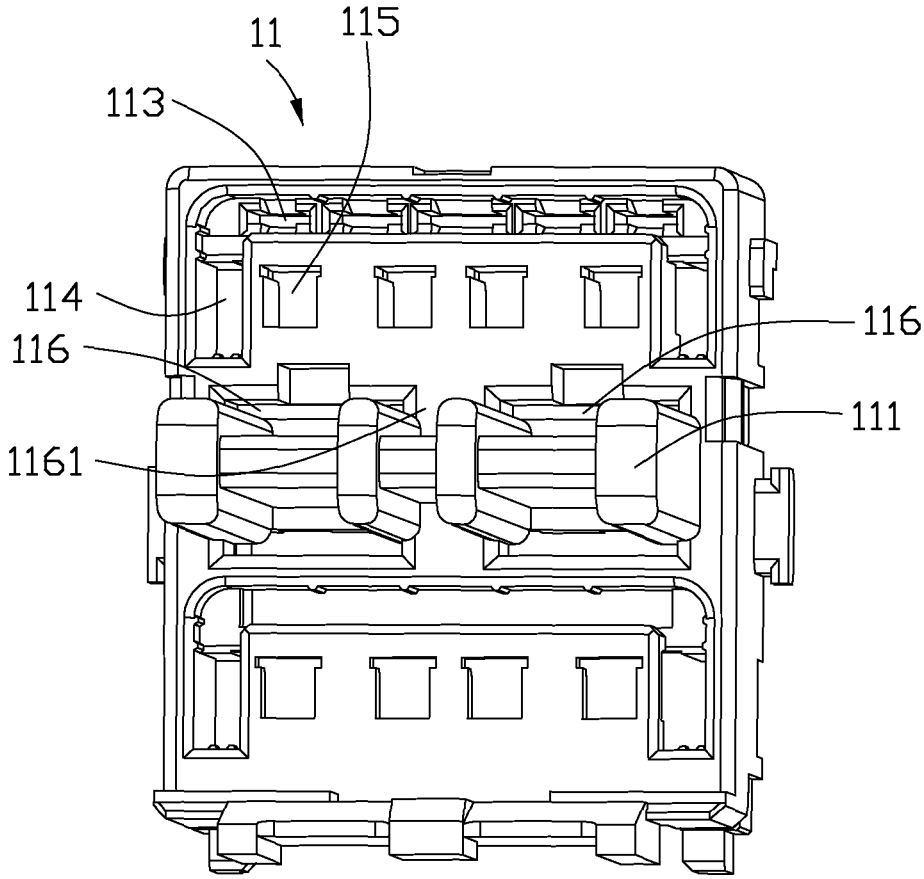
FIG. 6 is exploded view of a base portion of the electrical connector.

Referring to FIGS. 5-6, the insulative housing 1 includes a body portion 11, a plurality of tongues 12 assembled into the body portion 11 along a front to rear direction and a spacer 13 mounted into the body portion 11 along a up to down direction. The body portion 11 includes a base portion 110, a separating plate 111 extending forwardly from the base portion 110 and a supporting plate 112 extending forwardly from a bottom edge of the base portion 110. The base portion 110 has a front wall 1101, a top wall 1102, two side walls 1103, and a mounting space 1104 surrounded by the front, top, and two side walls. The base portion 110 has a plurality of first mounting slot 113 depressed upwardly and backwardly from a front wall 1101 of the base portion 110, a plurality of second slots 114 extending downwardly from two sides of the first mounting slot 113 and passing through the base portion 110 along the front to rear direction and a plurality of positioning slots 115 located in the bottom of the first mounting slots 113 and passing through the base portion 110 along the front to rear direction. A plurality of retaining slots 116 passing through the base portion 110 along the front to rear direction and located in the top and bottom sides of the separating plate 111. The retaining slots 116 has a attaching post 1161 separated the retaining slots 116 from two part of the left and right parts.

The insulative housing 1 includes two tongues 12 each are an upper tongue and a bottom tongue. The structure of the upper tongue is same as that of the bottom tongue. The separating plate 111 is located between the two tongues. The two tongues are assembled into the base portion 110 along the front to rear direction. The tongue 12 includes a first mounting portion 121 received in the first mounting slot 113, two second mounting portions 122 extending backwardly from the two sides of the first mounting slot 113 and mounted in the second mounting slots 114 and a flatting portion 123 extending forwardly from the first mounting portion 121. The second mounting portion 122 includes a retaining portion 1221 extending into the notches 117 for preventing the tongue 12 from moving. The tongue 12 has a plurality of first receiving slot 124 and a plurality of second receiving slot 125 located in the front of the first receiving slot 124.

The spacer 13 is mounting in the mounting space 1104 of the base portion 110, The spacer 13 includes a first insulative block 131 and a second insulative block 132. The first insulative block 131 includes a horizontal portion 1311 and a retaining block 1312 extending upwardly from the horizontal portion 1311 and a attaching portion 1313 extending upwardly from a rear of the horizontal portion 1311. A attaching spacer 1314 is defined between the retaining block 1312 and the attaching portion 1313. The retaining block 1312 has a plurality of first accommodating slot 1315 pass through therethrough along up to down direction and a plurality of second accommodating slots 1316. The first insulative block 131 has a plurality of third receiving slot 1317 passing through the horizontal portion 1311 downwardly and a plurality of fourth receiving slot 1318. The third receiving slot 1317 is located in the front of the fourth receiving slot 1318.

The second insulative block 132 includes a vertical portion 1321 and a protruding portion 1322 extending forwardly from a bottom edge of the vertical portion 1321. A stepping portion 1324 is defined between the vertical portion 1321 and the protruding portion 1322. The protruding portion 1322 has a plurality of third accommodating slots 1325 pass therethrough along the up to down direction and the vertical portion 1321 has a plurality of fourth accommodating slot 1326 passing therethrough along the up to down direction. The fourth accommodating slot 1326 extends downwardly to define a groove 1323 behind the protruding portion 1322. The protruding portion 1322 is received in the attaching space 1314 of the first insulative block 131. The stepping portion 1324 resists the attaching portion 1313 downwardly.

The contacts 3 includes a bottom group of contacts received in the bottom tongue 12 and an upper group of contacts received in the upper tongue 12. The bottom group of the contacts include a first group of contacts 31 having a plurality of first contacts and a second group of contacts 32 having a plurality of second contacts 320. The first contact 310 includes a first positioning portion 313 retained in the positioning slot 115, a first retaining portion 312 retained in the first receiving slot 124, a first contacting portion 321 extending forwardly from the first retaining portion 312, a first extending portion 312 extending downwardly from a rear of the first retaining portion 312 and received in the first accommodating slot 1315 and a first soldering portion 315 extending downwardly out of the spacer 13.

The second group of contacts 32 include a second retaining portion (not label), a second contacting portion extending forwardly from the second retaining portion and a second extending portion 322 extending downwardly from a rear of the retaining portion and received in the second accommodating slot 1316 and a second soldering portion 323 extending downwardly from the second extending portion 322.

The upper group of the contacts include a third group of contacts 33 having a plurality of third contacts 330 and a fourth group of the contacts 34 having a plurality of fourth contacts 340. The structure of the third contacts is same as that of the first contacts 310. The third contacts include a third contacting portion 331, a third extending portion 334 received in the third accommodating slot 1325 and the third receiving slot 1317 and a third soldering portion 335 extending out of the spacer 13. The structure of the fourth contact is same as that of the second contact. The fourth contact include a fourth contacting portion 341, a fourth extending portion 342 received in the fourth accommodating slot 1326 and fourth receiving slot 1318, a fourth soldering portion 343 extending out of the spacer 13.

The shield shell 2 includes an out shell 21, an inner shell 22 and a covering plate 23. The out shell 21 has a top wall 211, a bottom wall 212, two side walls 213 connecting the top and bottom walls 213 and a plurality of elastic plate 214. The side wall 213 has a plurality of soldering tails 215 extending downwardly from a bottom side of bottom wall 212. The out shell 21 is located upon the supporting plate 112. The top wall 211, the inner shell 22 and the upper tongue are formed an upper inserting slot 101. The bottom wall 212, the inner shell 22 and the bottom tongue are formed a bottom inserting slot 102.

The inner shell 22 includes a front surface 221, a pair of plating portion 222 extending backwardly from the front surface 221, a pair of extending arms 223 extending backwardly of the plating portion 222 and a side portion 224 extending backwardly from two sides of the front surface 221. The plating portion 222 has a plurality of elastic arms 225. A retaining space 2230 is defined by the front surface 221, two plating portion 222 and the extending arms 223. The inner shell 22 is mounted into the separating plate 111 along the front to rear direction. The attaching post 1161 of the base portion 110 is received in the retaining space 2230. The plating portion 222 of the inner shell 22 abuts against the attaching post 1161 backwardly. The extending arm 223 is received in the retaining slot 116 and extending into the mounting space 1104.

Figure 3:
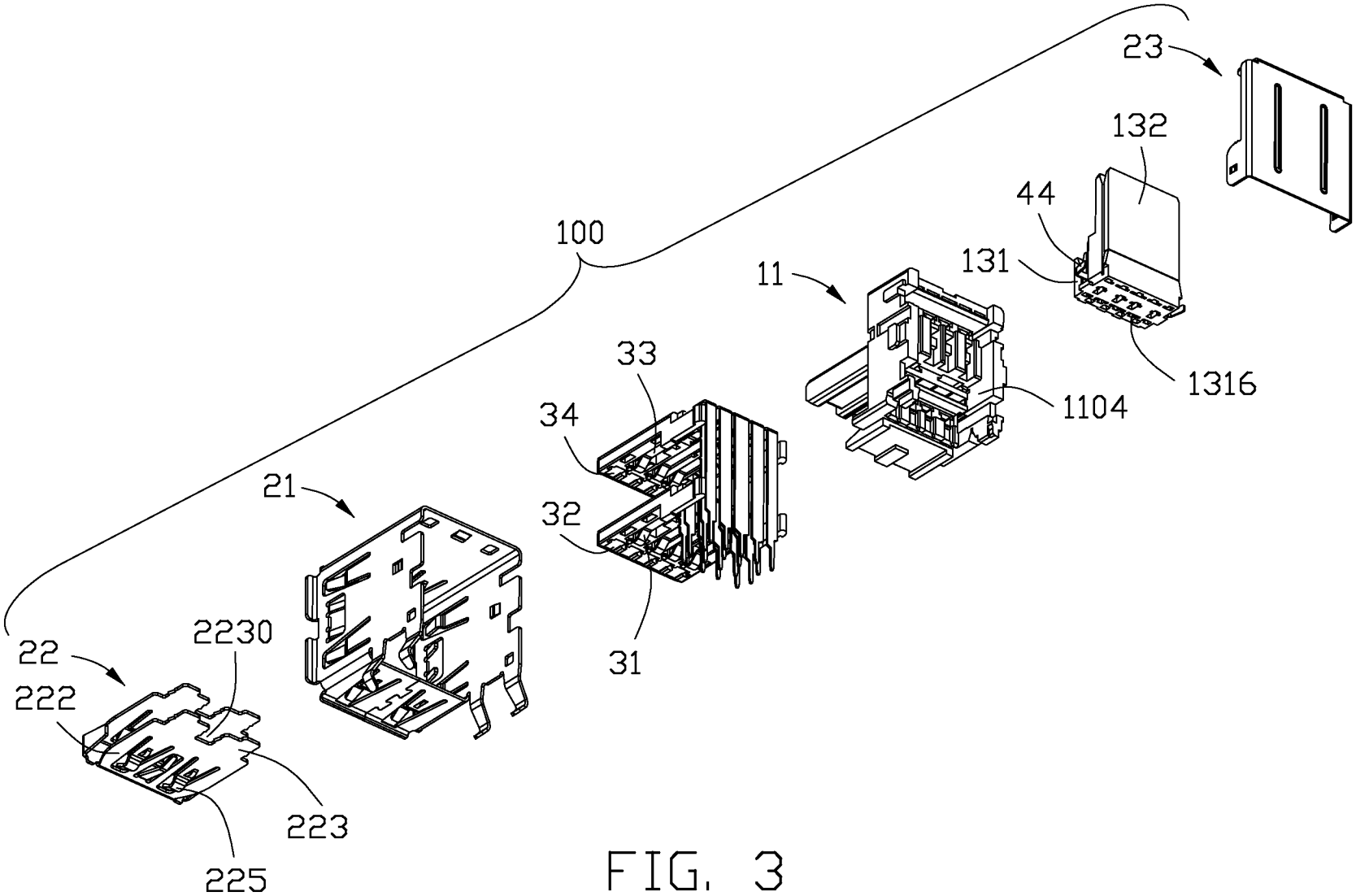
FIG. 3 is another partially exploded view of the electrical connector as shown in FIG. 2.
Figure 4:
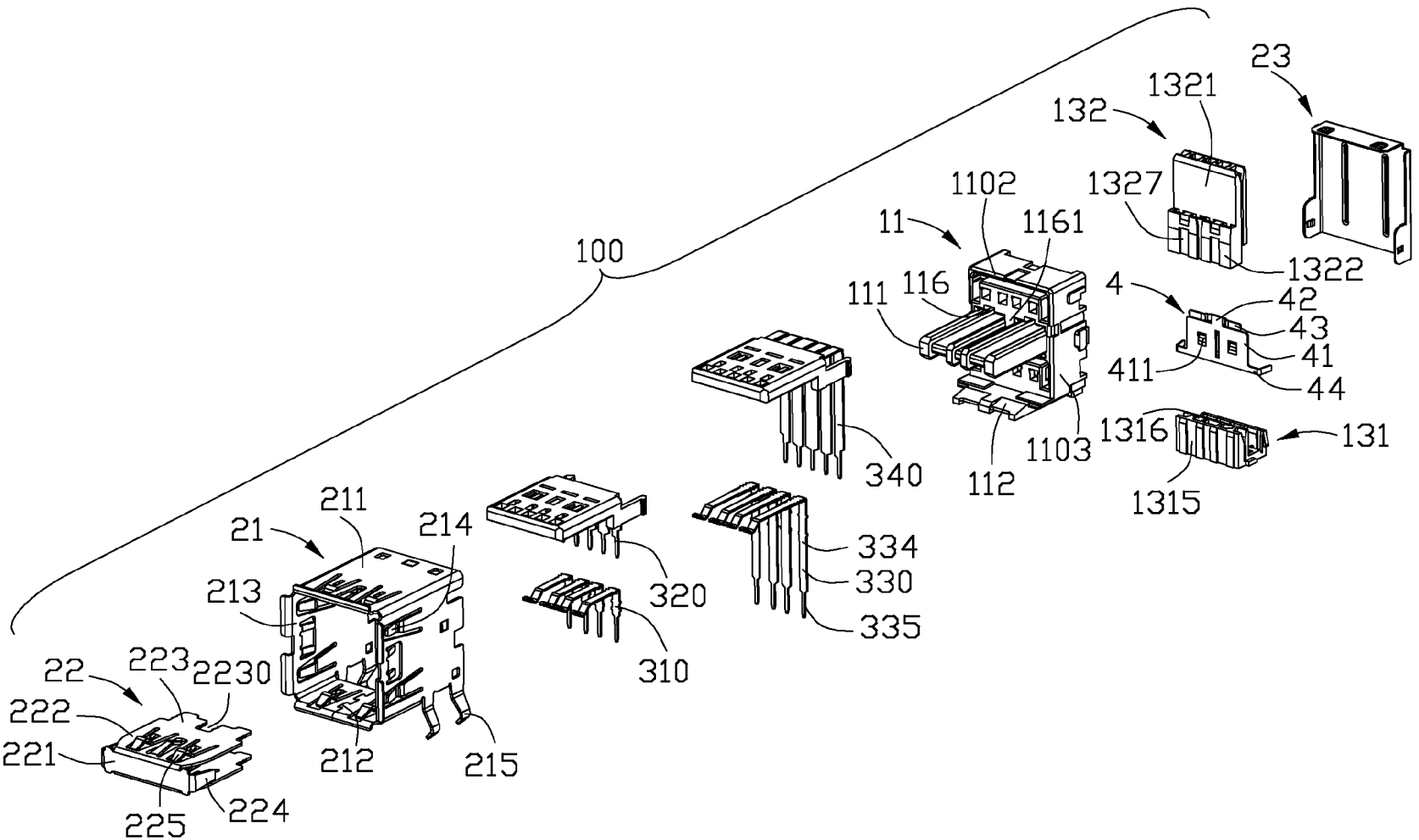
FIG. 4 is an exploded view of the electrical connector.

The metal shield plate 4 includes a mounting plate 41, a convex extending upwardly from a top of the mounting plate 41, a resisting arm 43 extending outside of two sides of the convex 42, a connecting arm 44. The resisting arm 43 includes a first part 431 and a second part 432. The part 432 is parallel with the mounting plate 41 and the resisting extends mot beyond the two sides of the mounting plate 41. Referring to FIGS. 2-3, the shield plate 4 is mounted in the spacer 13 along the up to down direction. The shield plate 4 is located between the retaining block 1312 and the protruding portion 1322. The resisting arm 41 of the shield plate 4 is located upon the retaining block 1312. To observe along the front to rear direction, the first and second extending portion 314, 322 are located in the front of the shield plate 4 and the third and fourth extending portion 334, 342 are located in the rear of the shield plate 4. The shield shell is inserting molded in the spacer.

Figure 7:
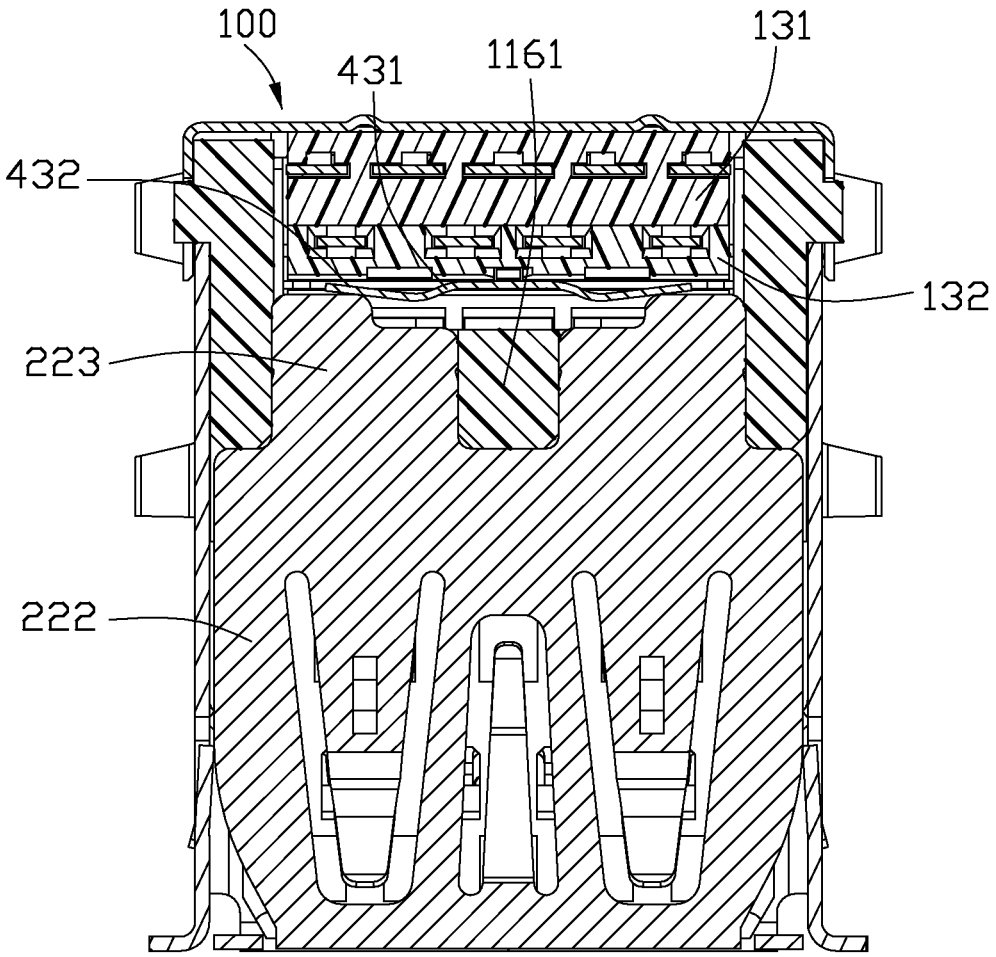
FIG. 7 is a cross-sectional view of the electrical connector, taken along line 7-7 of FIG. 1.

Referring to FIG. 7, the spacer 13 is mounted into the insulative housing 110, the resisting arm 43 of the shield plate 4 is located in the rear of the retaining slot 116 of the inner shell 22. The extending arm 223 of the inner shell 22 is received in the retaining slot 116 and extending into the retaining slot 116. The resisting arm 43 abuts against the extending arm 223 electrically. The connecting arms 44 are connected with the two side walls 213 of the out shell 21 electrically.

The electrical connector 100 includes the shield plate 4 connecting with the inner shell 22 directly. The inner shell 22 is located between the upper group of contact and the bottom group of contact. As a result, cross-talk between the upper and bottom group of contacts and it would improve signal transmission quality of the stacked electrical connector 100.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing having a body portion and a spacer;

a plurality of contacts received in the body portion;

a metallic shield shell covering the insulative housing, the shield shell includes an outer shell and an inner shell, the inner shell enclosed by the shield shell and separating the insulative housing into two parts with an upper inserting space and a bottom inserting space;

a metallic shield plate received in the spacer and directly abutting against a rear portion of the inner shell mechanically and electrically.

2. The electrical connector as claimed in claim 1, wherein the shield shell is insert-molded in the spacer.

3. The electrical connector as claimed in claim 1, wherein the shield plate includes a mounting plate mounted in the spacer, a convex extending upwardly from the mounting plate and a pair of resisting arms extending from the convex, the resisting arm abuts against a rear of the inner shell forwardly.

4. The electrical connector as claimed in claim 3, wherein the shield plate has a pair of resisting arms extending from two sides of the mounting plate, the resisting arm abuts against the inner surface of the out shell.

5. The electrical connector as claimed in claim 3, wherein the body portion includes a base portion and a separating plate extending forwardly from the base portion, a mounting space is formed in a rear of the base portion, the inner shell is mounted in the separating plate and the spacer is mounted in the mounting space.

6. The electrical connector as claimed in claim 5, wherein the base portion has a plurality of the retaining slot passing therethrough, the inner shell has a extending arm pass through the retaining slot and extending into the mounting space, the resisting arm resists the extending arm of the shield plate.

7. The electrical connector as claimed in claim 6, wherein the retaining slot has a attaching post located in the middle thereof, the inner shell has a plating portion resisting the attaching post forwardly, the extending arm extends from the plating portion.

8. The electrical connector as claimed in claim 5, wherein the spacer includes a first insulative block and a second insulative block, the first insulative block has a horizontal portion, a retaining block extending upwardly from the horizontal portion and a attaching portion extending upwardly from a rear of the retaining block.

9. The electrical connector as claimed in claim 8, wherein the second insulative block includes a vertical portion and a protruding portion extending forwardly from the vertical portion, the protruding portion is located between the retaining block and the attaching portion, the shield plate of the shield plate is located between the protruding portion and the retaining block of the first insulative housing.

10. The electrical connector as claimed in claim 5, wherein the insulative housing includes a plurality of tongues assembled into the base portion, the tongues include an upper tongue and a bottom tongue, the separating plate is located between the upper and bottom tongues.

11. The electrical connector as claimed in claim 10, wherein the contacts include a bottom group of contacts received in the bottom tongue and an upper group of contacts received in the upper tongue, the bottom group of contacts each include a plurality of first and second contacts, the upper group of contacts each include a plurality of third and fourth contacts, the first and second contact includes a first and a second extending portion, the third and fourth contact includes a third and a fourth extending portion, the shield plate is located between the second and third extending portion.

12. A stacked electrical connector comprising:

an insulative housing having a body portion, an upper and a bottom tongues extending forwardly from the body portion;

a plurality of contacts including an upper group of contacts received in the upper tongue and a bottom group of contacts received in the bottom tongue, the upper and bottom contacts each having a retaining portion retained in the body and an extending portion extending downwardly from a rear of the retaining portion;

a metallic shield shell having an inner shell located between the upper and bottom tongues;

a metallic shield plate located between the extending portion of the upper and bottom groups of the contacts and mechanically and electrically directly abuts against a rear portion of the inner shell forwardly.

13. The electrical connector as claimed in claim 12, wherein the insulative housing includes a spacer for retaining the contacts and mounted into the body portion, the shield plate is received in the spacer and extending out of the spacer.

14. The electrical connector as claimed in claim 13, wherein the body portion includes a base portion and a separating plate extending forwardly from the base portion, a mounting space is formed in a rear of the base portion, the inner shell is mounted in the separating plate and the spacer is mounted in the mounting space.

15. The electrical connector as claimed in claim 13, wherein the shield plate includes a mounting plate mounted in the spacer, a convex extending upwardly from the mounting plate and a pair of resisting arms extending from the convex, the resisting arm abuts against a rear of the inner shell forwardly.

16. The electrical connector as claimed in claim 15, wherein the retaining slot has a attaching post located in the middle thereof, the inner shell has a plating portion resisting the attaching post forwardly, the extending arm extends from the plating portion.

17. An electrical connector comprising:

an insulative housing defining opposite upper and lower mating ports in a vertical direction, each of said upper and lower mating ports forwardly communicating with an exterior in a front-to-back direction perpendicular to said vertical direction;

a plurality of upper contacts disposed in the housing with forward contacting sections exposed in the upper mating port and downward tail sections;

a plurality of lower contacts disposed in the housing with forward contacting sections exposed in the lower mating port and downward tail sections;

an insulative space located behind the housing to align said tails sections of both the upper contacts and the lower contacts;

a metallic horizontal inner shell located between the upper mating port and the lower mating port; and a metallic vertical shielding plate separating the tail sections of the upper contacts and those of the lower contacts in the front-to-back direction;

wherein said inner shell and said shielding plate are electrically and mechanically directly connected with each other.

18. The electrical connector as claimed in claim 17, wherein said shielding plate further includes a side finger mechanically and electrically connected to an outer shell which encloses the housing and mechanically and electrically connected to the inner shell around a front face of the housing.

19. The electrical connector as claimed in claim 17, wherein the spacer includes a lower part aligning the tail sections of the lower contacts and an upper part aligning the tails sections of the upper contacts, respectively.

20. The electrical connector as claimed in claim 19, wherein said lower part defines a cavity to receive a lower portion of the upper part.

* * * * *